US010804619B2

(12) United States Patent
Chou

(10) Patent No.: US 10,804,619 B2
(45) Date of Patent: Oct. 13, 2020

(54) HIGH FREQUENCY ANTENNA DEVICE AND ANTENNA ARRAY THEREOF

(71) Applicant: AUDEN TECHNO CORP., Taoyuan (TW)

(72) Inventor: Jui-Hung Chou, Taoyuan (TW)

(73) Assignee: AUDEN TECHNO CORP., Taoyuan (TW)

( * ) Notice: Subject to any disclaimer, the term of this patent is extended or adjusted under 35 U.S.C. 154(b) by 0 days.

(21) Appl. No.: 16/507,861

(22) Filed: Jul. 10, 2019

(65) Prior Publication Data

US 2020/0169006 A1 May 28, 2020

(30) Foreign Application Priority Data

Nov. 23, 2018 (TW) ..... 107141839 A

(51) Int. Cl.
*H01Q 21/06* (2006.01)
*H01Q 21/24* (2006.01)

(52) U.S. Cl.
CPC ..... *H01Q 21/245* (2013.01)

(58) Field of Classification Search
CPC ..... H01Q 21/245; H01Q 21/065; H01Q 21/0006; H01Q 21/24; H01Q 21/061; H01Q 21/08; H01Q 23/00; H01Q 1/36; H01Q 1/50
See application file for complete search history.

(56) References Cited

U.S. PATENT DOCUMENTS

| | | | | |
|---|---|---|---|---|
| 10,320,087 | B2 * | 6/2019 | Miraftab | H01Q 21/30 |
| 2019/0006751 | A1 * | 1/2019 | Chen | H01Q 3/36 |
| 2020/0083948 | A1 * | 3/2020 | Lim | H01Q 3/2605 |
| 2020/0169005 | A1 * | 5/2020 | Chou | H01Q 1/243 |

* cited by examiner

*Primary Examiner* — Dameon E Levi
*Assistant Examiner* — David E Lotter
(74) *Attorney, Agent, or Firm* — Li & Cai Intellectual Property (USA) Office

(57) ABSTRACT

An antenna array of a high frequency antenna device includes a plurality of subarrays having the same arrangement. Each subarray includes antennas arranged in rows. Any two adjacent antennas of each of the subarrays respectively have two central points spaced apart from each other by a first interval, and any two adjacent antennas respectively belonging to two of the subarrays respectively have two central points spaced apart from each other by a second interval equal to the first interval. The antenna array is operated in at least one of operation modes, and the operation modes include: any subarray is wirelessly communicated with an external electronic device spaced apart from the corresponding subarray by a first distance; and at least two adjacent subarrays are jointly cooperated to wirelessly communicate with an external electronic device spaced apart from the corresponding subarrays by a second distance greater than the first distance.

10 Claims, 11 Drawing Sheets

HIGH FREQUENCY ANTENNA DEVICE AND ANTENNA ARRAY THEREOF

CROSS-REFERENCE TO RELATED PATENT APPLICATION

This application claims the benefit of priority to Taiwan Patent Application No. 107141839, filed on Nov. 23, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a high frequency antenna, and more particularly to a high frequency antenna device and an antenna array thereof for a frequency band within a range of 20-45 GHz.

BACKGROUND OF THE DISCLOSURE

A conventional high frequency antenna is applied to the fourth generation of mobile phone mobile communication technology standards (i.e., 4G), so that the structural design of the conventional high frequency antenna is only used for a non-millimeter wave frequency band (e.g., 2.6 GHz) and is difficult to be used for a higher frequency band (e.g., 20-45 GHz). However, increasing operation frequency has become a trend in communication. Therefore, how a new high frequency antenna can be designed to satisfy a higher frequency band by improving the conventional high frequency antenna has become a technical issue to be solved in the relevant field.

SUMMARY OF THE DISCLOSURE

In response to the above-referenced technical inadequacies, the present disclosure provides a high speed probe card device and a rectangular probe to effectively improve the issues associated with conventional probe card devices.

In one aspect, the present disclosure provides a high frequency antenna device for an operation frequency band within a range of 20-45 GHz. The high frequency antenna device includes a substrate, an antenna array, and a plurality of processing chips. The substrate has a first board surface and a second board surface opposite to the first board surface. The antenna array is disposed on the first board surface of the substrate and includes a plurality of subarrays spaced apart from each other. Each of the subarrays includes a plurality of antennas arranged in rows, and the subarrays have the same arrangement. Any two of the antennas of each of the subarrays adjacent to each other respectively have two central points spaced apart from each other by a first interval, and any two of the antennas respectively belonging to two of the subarrays and arranged adjacent to each other respectively have two central points spaced apart from each other by a second interval equal to the first interval. The processing chips are mounted on the second board surface of the substrate. The processing chips are electrically coupled to the subarrays, respectively, so that each of the processing chips is electrically coupled to the antennas of the corresponding subarray. The antenna array has a plurality of operation modes and is operated in at least one of the operation modes. The operation modes include a first mode and a second mode. The first mode is implemented as follows: any one of the subarrays is wirelessly communicated with an external electronic device spaced apart from the corresponding subarray by a first distance within a first range. The second mode is implemented as follows: two of the subarrays adjacent to each other are jointly cooperated to wirelessly communicate with an external electronic device spaced apart from the corresponding two subarrays by a second distance within a second range, and the first distance is less than the second distance.

In one aspect, the present disclosure provides an antenna array of a high frequency antenna device for an operation frequency band within a range of 20-45 GHz. The antenna array includes a plurality of subarrays spaced apart from each other. Each of the subarrays includes a plurality of antennas arranged in rows, and the subarrays have the same arrangement. Any two of the antennas of each of the subarrays adjacent to each other respectively have two central points spaced apart from each other by a first interval, and any two of the antennas respectively belonging to two of the subarrays and arranged adjacent to each other respectively have two central points spaced apart from each other by a second interval equal to the first interval. The antenna array has a plurality of operation modes and is operated in at least one of the operation modes, and the operation modes include a first mode and a second mode. The first mode is implemented as follows: any one of the subarrays is wirelessly communicated with an external electronic device spaced apart from the corresponding subarray by a first distance within a first range. The second mode is implemented as follows: at least two of the subarrays adjacent to each other are jointly cooperated to wirelessly communicate with an external electronic device spaced apart from the corresponding at least two subarrays by a second distance within a second range, and the first distance is less than the second distance.

Therefore, the high frequency antenna device (and the antenna array) of the present disclosure has a plurality of operation modes, and the antenna array can be operated in at least one of operation modes. Accordingly, the antenna array of the high frequency antenna device can be operated by automatically selecting at least one of the operation modes according to the position of at least one external electronic device, so that the high frequency antenna device can effectively achieve a better operation performance.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
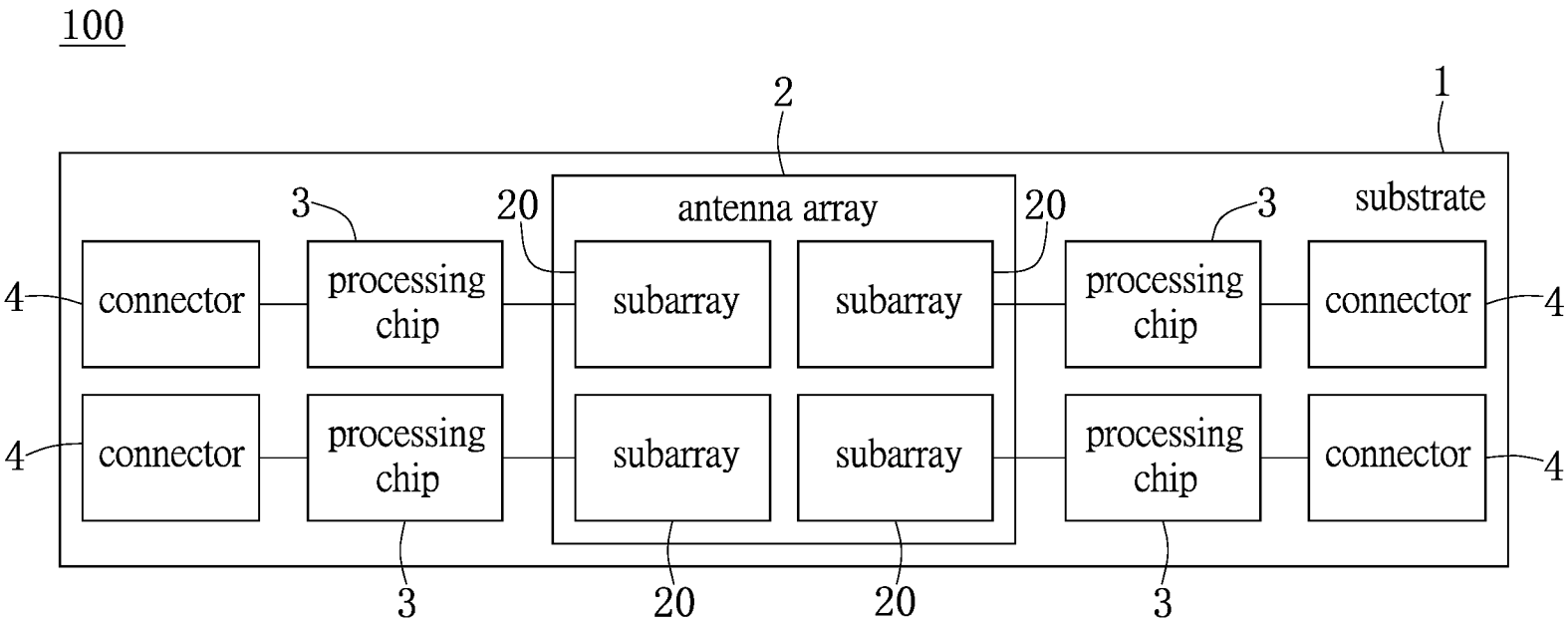
FIG. 1 is a functional block of a high frequency antenna device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Referring to FIG. 1 to FIG. 10, a first embodiment of the present disclosure provides a high frequency antenna device 100 for an operation frequency band within a range of 20-45 GHz. That is to say, any antenna device not applied to 20-45 GHz is different from the high frequency antenna device 100 of the present embodiment. The operation frequency band of the present embodiment is limited to be within a range of 24-26.5 GHz, a range of 26.5-28.5 GHz, a range of 37-40 GHz, or a range of 40-43.5 GHz, but the present disclosure is not limited thereto.

As shown in FIG. 1, the high frequency antenna device 100 includes a substrate 1, an antenna array 2 and a plurality of processing chips 3 both respectively disposed on two opposite sides of the substrate 1, and a plurality of connectors 4 mounted on the substrate 1. The antenna array 2 in the present embodiment is described cooperatively with the above components, but the present disclosure is not limited thereto. For example, in other embodiments of the present disclosure, the antenna array 2 can be independently used or can be used in cooperation with other components.

Figure 2:
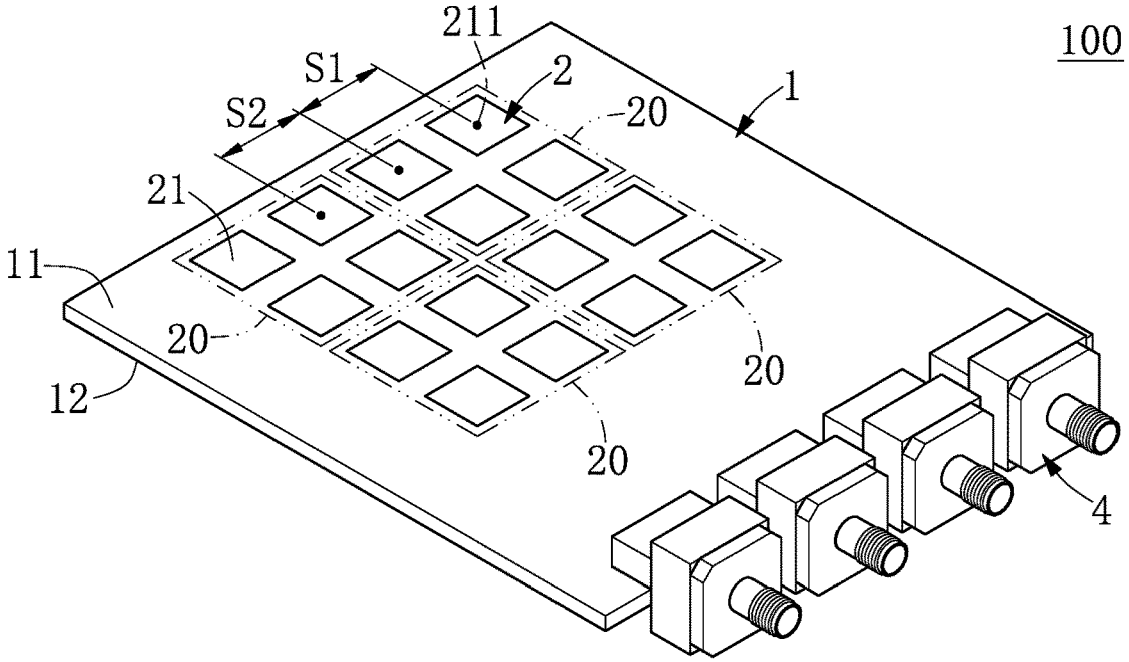
FIG. 2 is a perspective view of the high frequency antenna device according to the first embodiment of the present disclosure.
Figure 3:
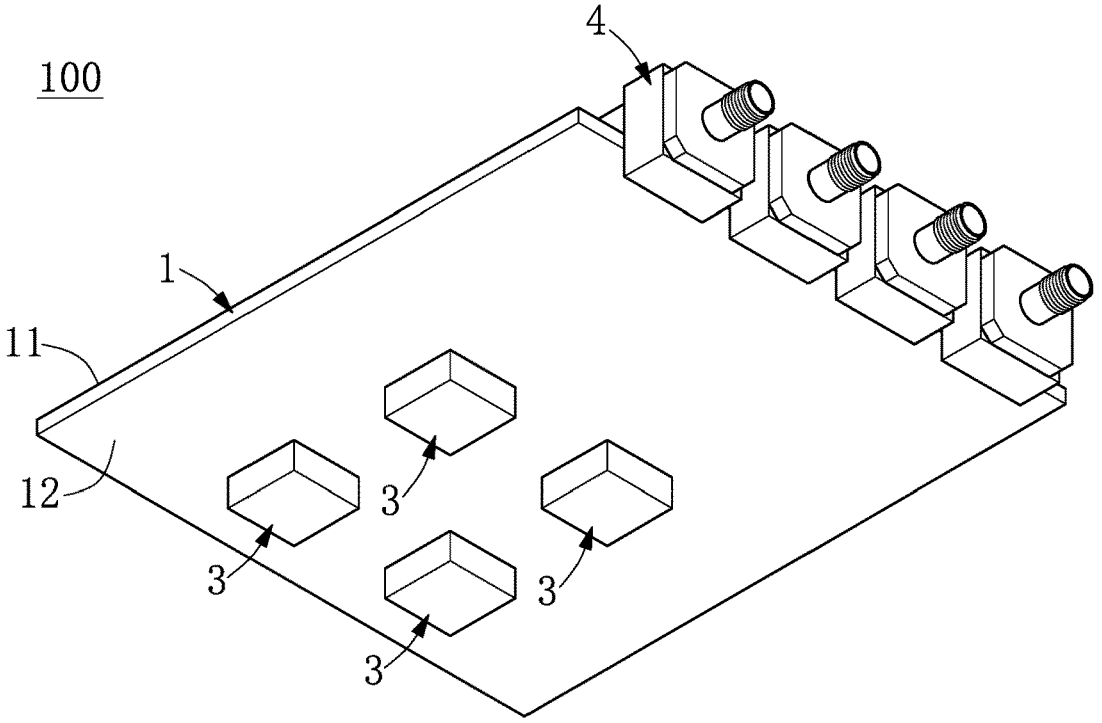
FIG. 3 is a perspective view of the high frequency antenna device from another view angle according to the first embodiment of the present disclosure.

As shown in FIG. 2 and FIG. 3, the substrate 1 has a first board surface 11 and a second board surface 12 opposite to the first board surface 11, and the substrate 1 in the present embodiment is a rectangular printed circuit board (PCB), but the present disclosure is not limited thereto.

As shown in FIG. 2 and FIG. 3, the antenna array 2 is disposed (or formed) on the first board surface 11 of the substrate 1, and the antenna array 2 in the present embodiment is configured to transmit a millimeter wave signal. The antenna array 2 includes a plurality of subarrays 20 spaced apart from each other. Each of the subarrays 20 includes a plurality of antennas 21 arranged in rows, and the subarrays 20 have the same arrangement.

It should be noted that the number of the subarrays 20 shown in FIG. 2 of the present embodiment is four, but the present disclosure is not limited thereto. For example, in other embodiments of the present disclosure, the number of the subarrays 20 of the antenna array 2 can be two or at least three.

Figure 4:
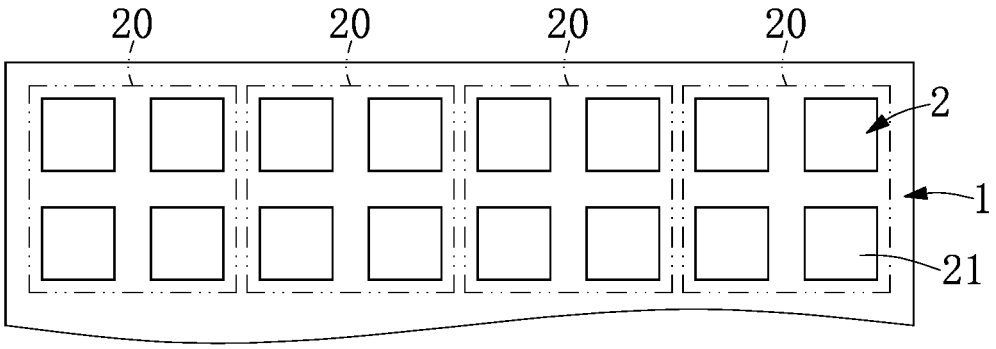
FIG. 4 is a perspective view showing the high frequency antenna device of FIG. 1 when subarrays of the high frequency antenna device are arranged in a straight line.
Figure 5:
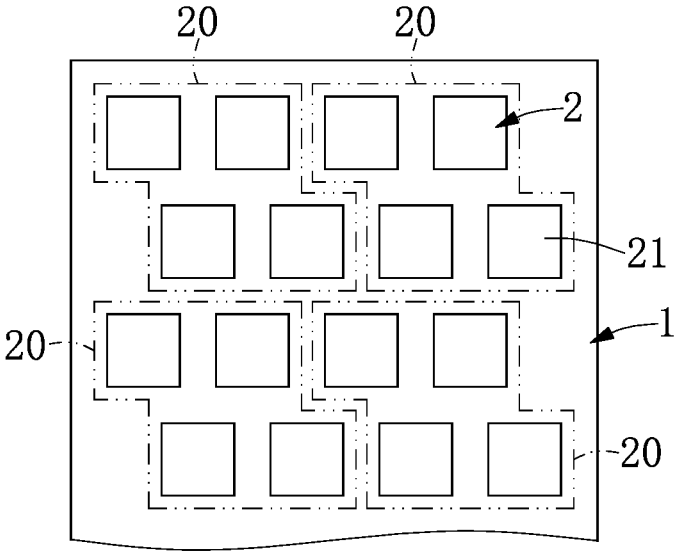
FIG. 5 is a perspective view showing the high frequency antenna device of FIG. 1 when subarrays of the high frequency antenna device are in a staggered arrangement.

Moreover, the arrangement of the subarrays 20 of the antenna array 2 can be adjusted according to design requirement. For example, the subarrays 20 of the antenna array 2 can be arranged in one row (as shown in FIG. 4) or are in a matrix arrangement (as shown in FIG. 2 and FIG. 5).

As shown in FIG. 2, the antennas 21 of the antenna array 2 in the present embodiment are arranged in M numbers of rows and N numbers of columns, each of M and N is a positive integer more than one, and the antennas 21 of the antenna array 2 are in a matrix arrangement. As shown in FIG. 5, the antennas 21 of the antenna array 2 in the present embodiment are arranged in M numbers of rows, M is more than one, and in two adjacent ones of the M numbers of rows, the antennas 21 of one of the two rows and the antennas 21 of the other one of the two rows are staggeredly arranged with each other.

Figure 6:
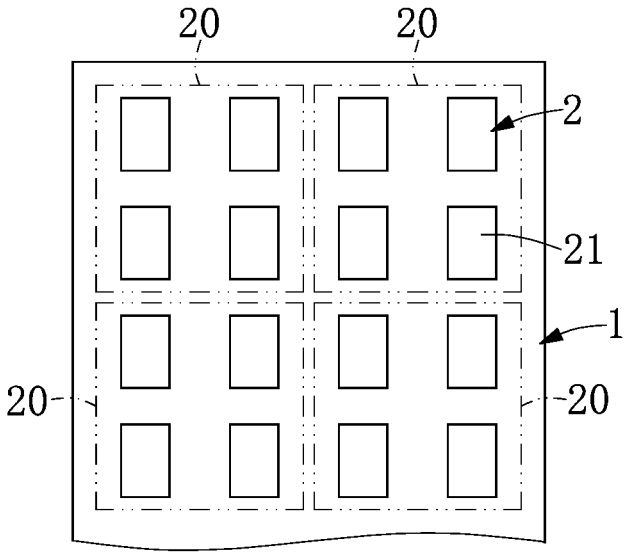
FIG. 6 is a perspective view showing the high frequency antenna device of FIG. 1 when each antenna has a rectangular shape.
Figure 7:
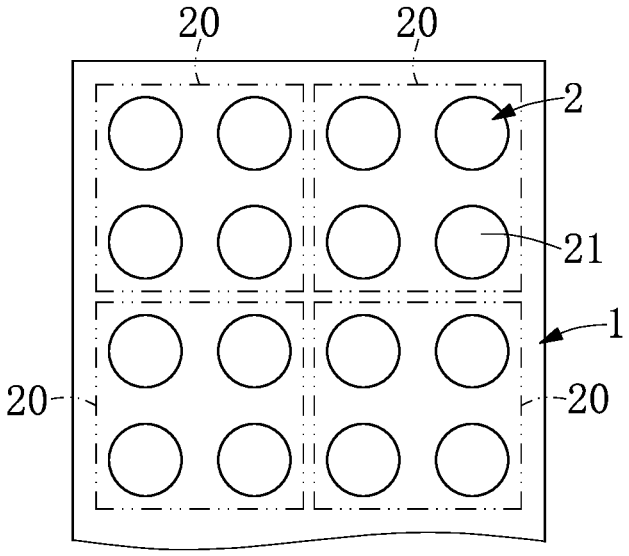
FIG. 7 is a perspective view showing the high frequency antenna device of FIG. 1 when each antenna has a round shape.

Specifically, the number of the antennas 21 of the antenna array 2 is sixteen, but the number of the antennas 21 can be adjusted according to design requirement. Moreover, shapes of the antennas 21 are substantially the same, and the shape of each of the antennas 21 can be a square (as shown in FIG. 2), a rectangle (as shown in FIG. 6), or a circle (as shown in FIG. 7), but the present disclosure is not limited thereto. Moreover, each of the antennas 21 in the present embodiment is a mono-polarized metal sheet configured to be operated in a horizontal polarization or a vertical polarization.

As shown in FIG. 2, any two of the antennas 21 of each of the subarrays 20 adjacent to each other respectively have two central points 211 spaced apart from each other by a first interval S1. Any two of the antennas 21 respectively belonging to two of the subarrays 20 and arranged adjacent to each other respectively have two central points 211 spaced apart from each other by a second interval S2 equal to the first interval S1. Accordingly, the condition about the second interval S2 equal to the first interval S1 is provided for the operation of the antenna array 2 in a second mode and a third mode that are disclosed in the following description. It should be noted that the central point 211 is located at an intersection of two diagonals of the antenna 21 shown in FIG. 2.

In addition, the operation frequency band has a central frequency corresponding to a wavelength. That is to say, the wavelength is a reciprocal of the central frequency. Moreover, the first interval S1 or the second interval S2 in the present embodiment is within a range of 0.25-0.75 times of the wavelength. The first interval S1 or the second interval S2 is preferably within a range of 0.35-0.65 (e.g., 0.5) times of the wavelength, but the present disclosure is not limited thereto.

As shown in FIG. 2 and FIG. 3, the processing chips 3 are mounted on the second board surface 12 of the substrate 1 and are electrically coupled to the subarrays 20, respectively so that each of the processing chips 3 is electrically coupled to the antennas 20 of the corresponding subarray 20. Moreover, the number of the processing chips 3 in the present embodiment is equal to the number of the subarrays 20, so that each of the subarrays 20 can be independently controlled by the corresponding processing chip 3, but the present disclosure is not limited thereto.

In other words, each of the processing chips 3 of the present embodiment is soldered onto the substrate 1, and is electrically coupled to the antennas 21 of the corresponding subarray 20 through conductive circuits (not shown) formed on the substrate 1. Accordingly, each of the processing chips 3 can be used to control (phase and amplitude of) signals received by or transmitted from the corresponding subarray 20.

The connectors 4 are mounted on the substrate 1, and each of the connectors 4 in the present embodiment is mounted on a periphery portion of the substrate 1. The connectors 4 are electrically coupled to the processing chips 3, respectively. Moreover, since each of the antennas 21 in the present embodiment is mono-polarized, the number of the connectors 4 is equal to that of the subarrays 20. In other words, the connectors 4 of the present embodiment are electrically coupled to the processing chips 3 through conductive circuits (not shown) formed on the substrate 1, and each of the connectors 4 is electrically coupled to the antennas 21 of the corresponding subarray 20 through the corresponding processing chip 3.

In the present embodiment, the antenna array 2 has a plurality of operation modes, and the operation modes include a first mode, a second mode, and a third mode, but the present disclosure is not limited thereto. The antenna array 2 can be operated in at least one of the operation modes. That is to say, the antenna array 2 can be operated in two of the operation modes at the same time (e.g., the antenna array 2 is operated in the first mode and the second mode at the same time shown in FIG. 9).

Figure 8:
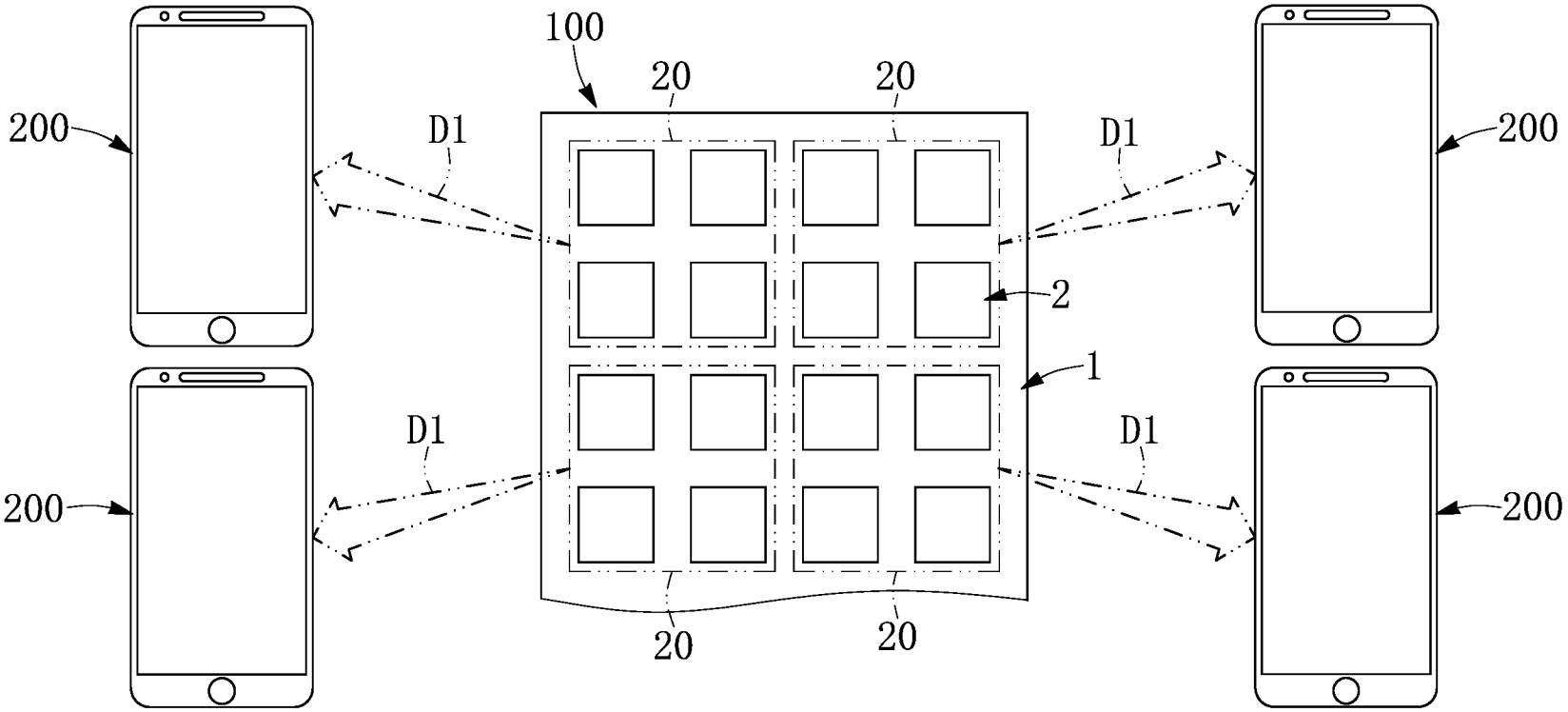
FIG. 8 is a schematic view showing an antenna array of the high frequency antenna device of FIG. 2 operated in a first mode.

As shown in FIG. 8, the first mode is implemented as follows: any one of the subarrays 20 is wirelessly communicated with an external electronic device 200 (e.g., a smart phone) spaced apart from the corresponding subarray 20 by a first distance D1 within a first range. In other words, when all of the subarrays 20 of the antenna array 2 are operated in the first mode, the high frequency device 100 can be synchronously and wirelessly communicated with a plurality of external electronic devices 200, and the number of the external electronic devices 200 is equal to that of the subarrays 20.

Figure 9:
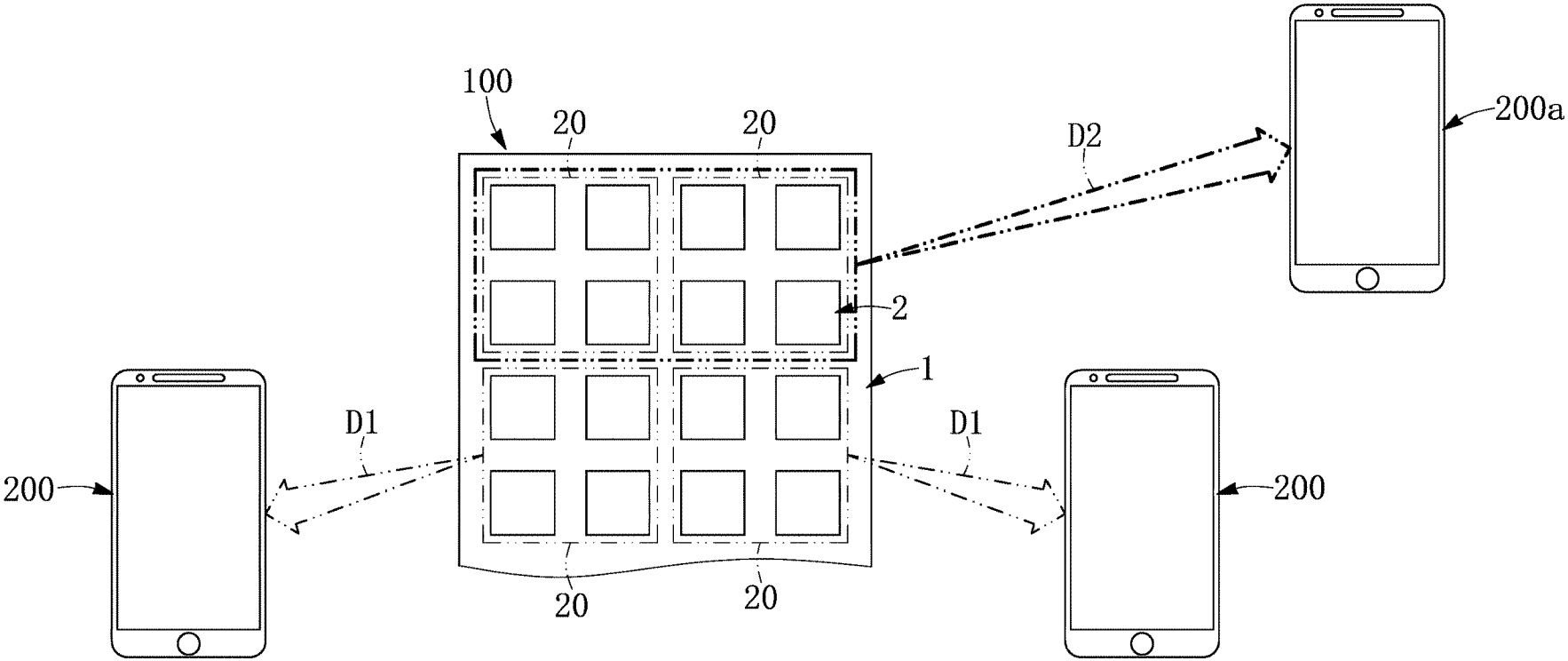
FIG. 9 is a schematic view showing the antenna array of the high frequency antenna device of FIG. 2 operated in the first mode and a second mode.

As shown in FIG. 9, the second mode is implemented as follows: at least two of the subarrays 20 adjacent to each other (e.g., the upper two subarrays 20 shown in FIG. 16) are jointly cooperated to wirelessly communicate with an external electronic device 200*a* (e.g., a smart phone) spaced apart from the corresponding two subarrays 20 by a second distance D2 within a second range, and the first distance D1 is less than the second distance D2. In other words, when a distance between the high frequency device 100 and the external electronic device 200*a* is between the first distance D1 and the second distance D2, the antenna array 2 can use at least two of the subarrays 20 adjacent to each other that jointly cooperate to wirelessly communicate with the external electronic device 200*a*.

Figure 10:
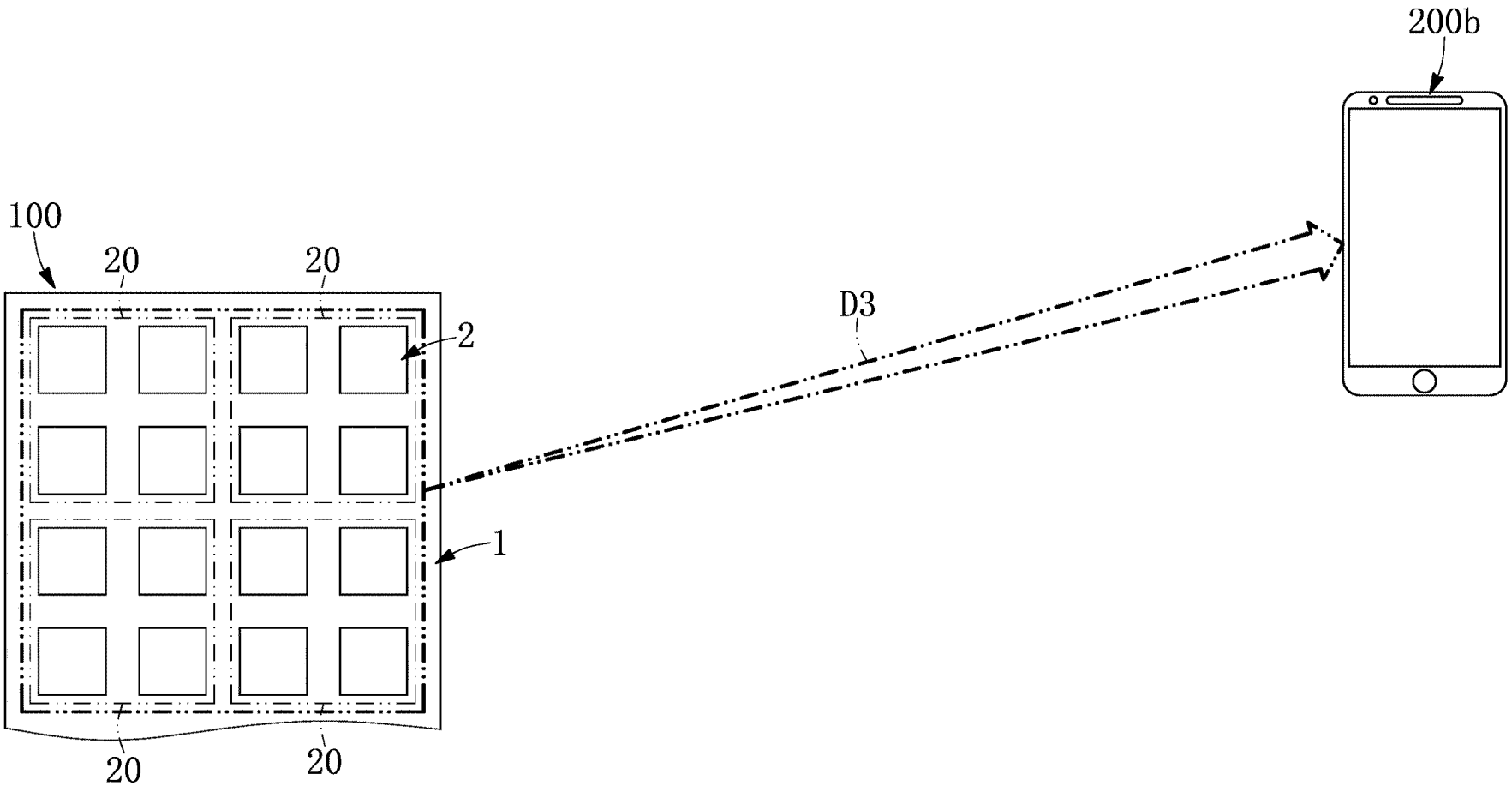
FIG. 10 is a schematic view showing the antenna array of the high frequency antenna device of FIG. 2 operated in a third mode.

As shown in FIG. 10, the third mode is implemented as follows: all of the subarrays 20 are jointly cooperated to wirelessly communicate with an external electronic device 200*b* (e.g., a smart phone) spaced apart from the subarrays 20 by a third distance D3 within a third range, and the second distance D2 is less than the third distance D3. In other words, when a distance between the high frequency device 100 and the external electronic device 200*b* is between the second distance D2 and the third distance D3, the antenna array 2 can use all of the subarrays 20 that jointly cooperate to wirelessly communicate with the external electronic device 200*b*.

Accordingly, the antenna array 2 of the high frequency antenna device 100 in the present embodiment can be operated by automatically selecting at least one of the operation modes according to the position of at least one external electronic device 200, 200*a*, 200*b*, so that the high frequency antenna device 100 can effectively achieve a better operation performance.

Second Embodiment

Figure 11:
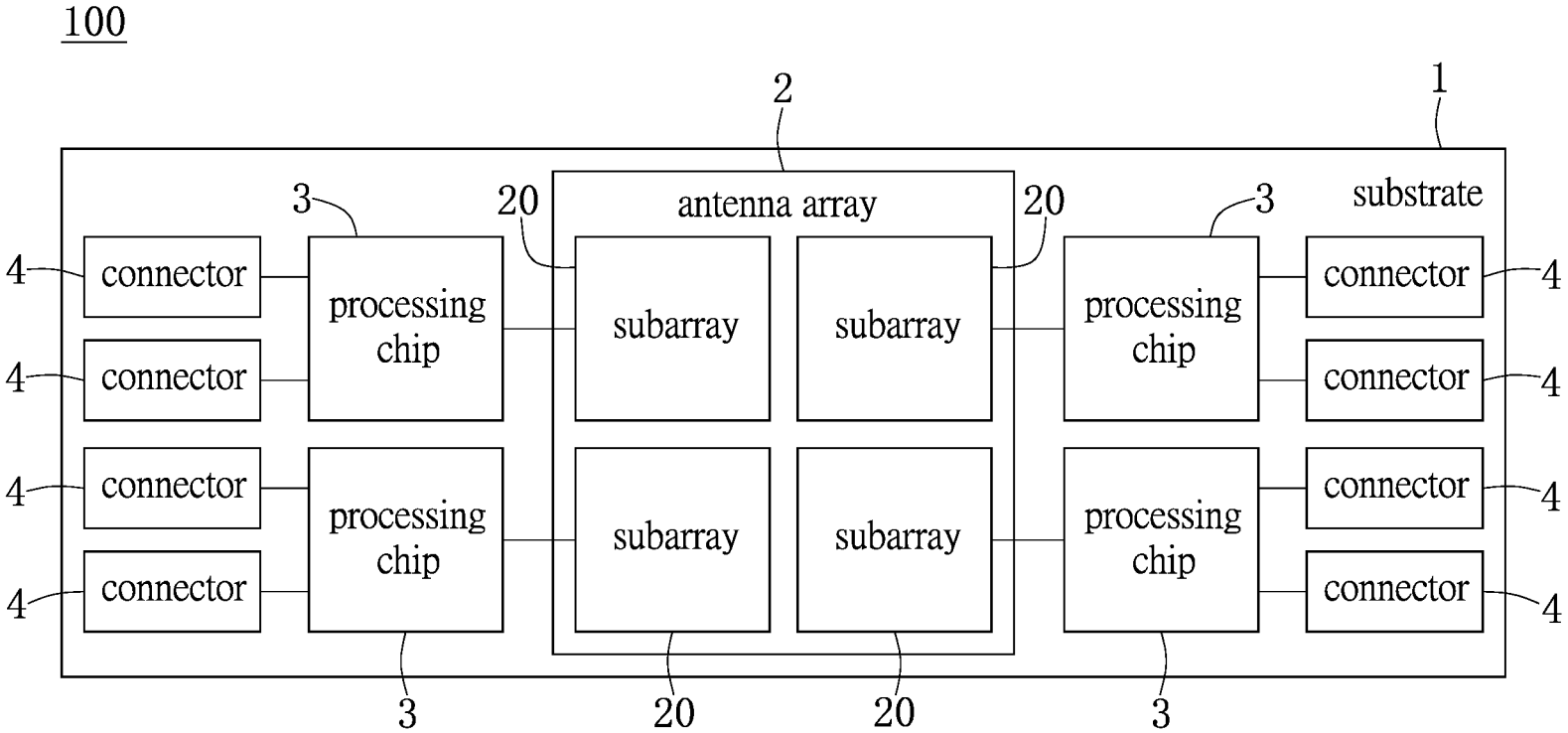
FIG. 11 is a functional block of a high frequency antenna device according to a second embodiment of the present disclosure.
Figure 12:
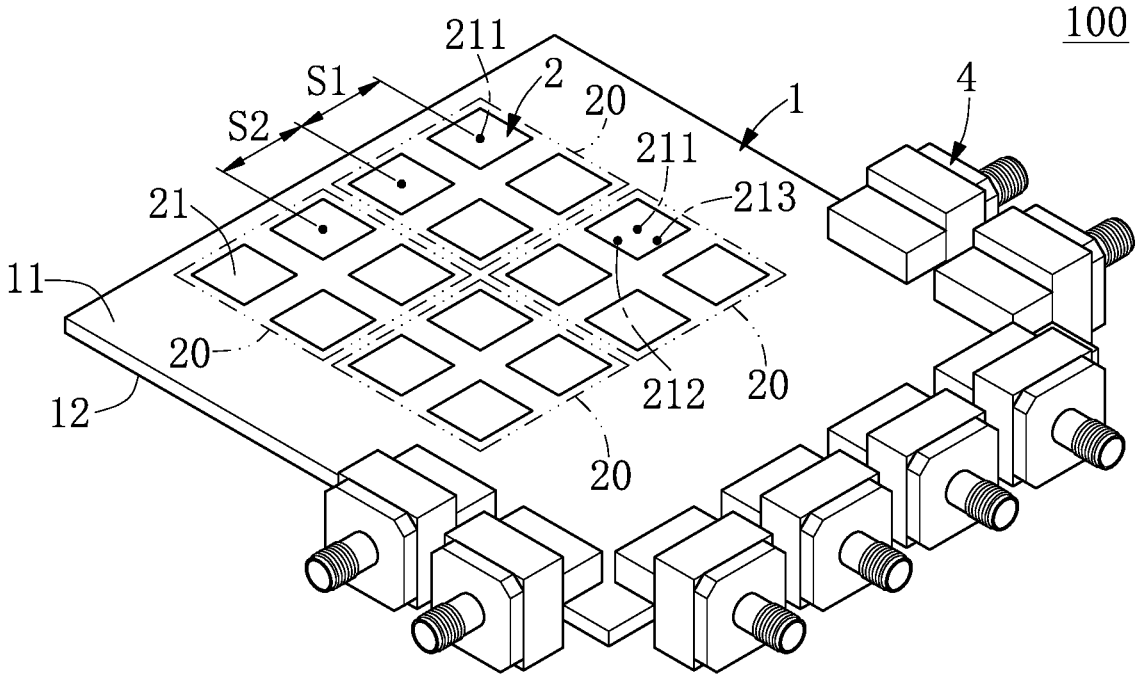
FIG. 12 is a perspective view of the high frequency antenna device according to the second embodiment of the present disclosure.

Referring to FIG. 11 and FIG. 12, a second embodiment of the present disclosure is similar to the first embodiment of the present disclosure, so that the descriptions of the same components in the first and second embodiments of the present disclosure will be omitted for the sake of brevity, and the following description only discloses different features between the first and second embodiments.

In the present embodiment, each of the antennas 21 is a dual-polarized metal sheet configured to be selectively operated in a horizontal polarization and a vertical polarization. Each of the antennas 21 preferably defines a first feeding point 212 in horizontal polarization and a second feeding point 213 in vertical polarization. In each of the antennas 21, the first feeding point 212, the second feeding point 213, and the central point 211 jointly define a right angle.

Moreover, since each of the antennas 21 in the present embodiment is dual-polarized, the number of the connectors 4 is double of the number of the subarrays 20, and each of the processing chips 3 is electrically coupled to two of the connectors 4.

Third Embodiment

Figure 13:
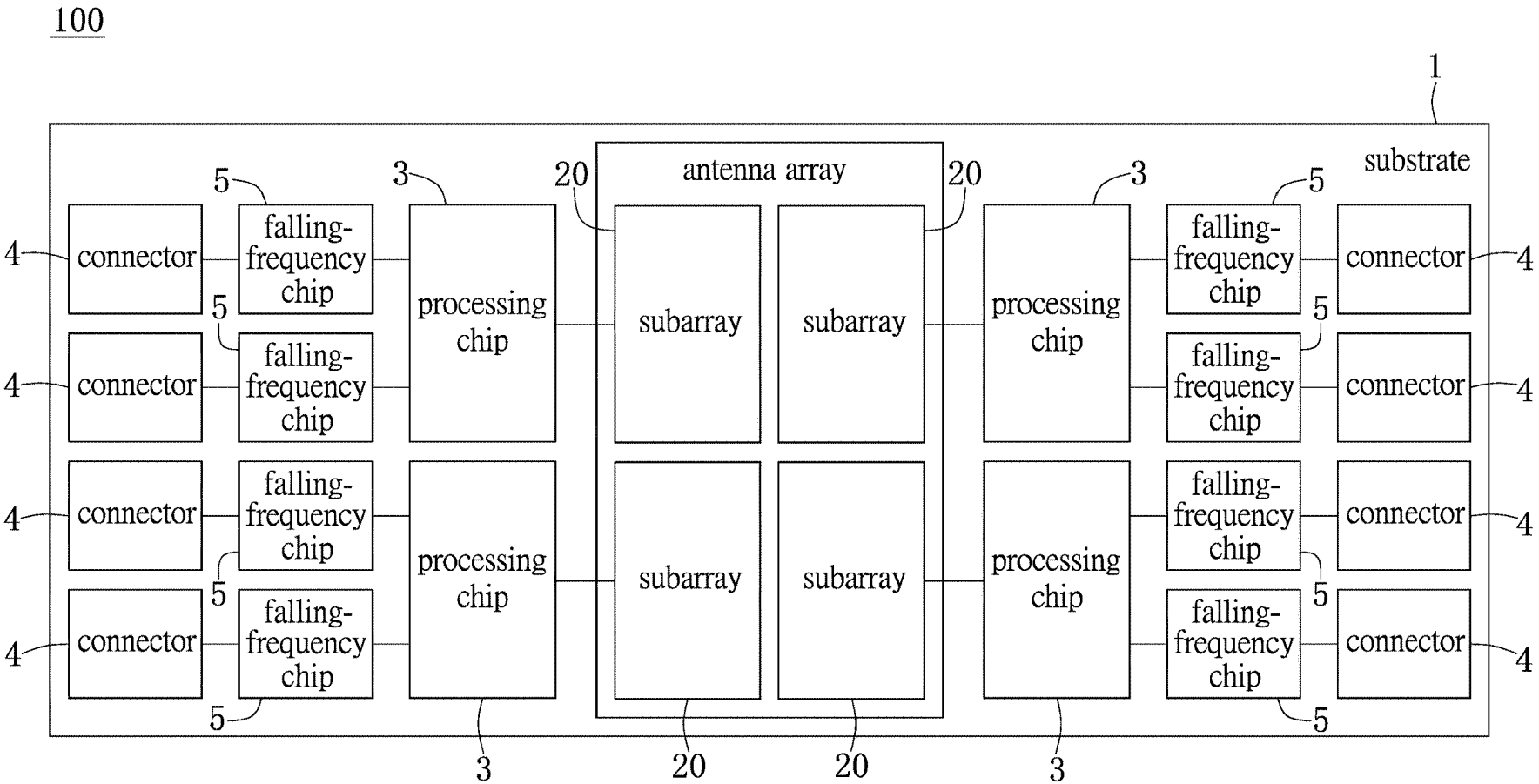
FIG. 13 is a functional block of a high frequency antenna device according to a third embodiment of the present disclosure.
Figure 14:
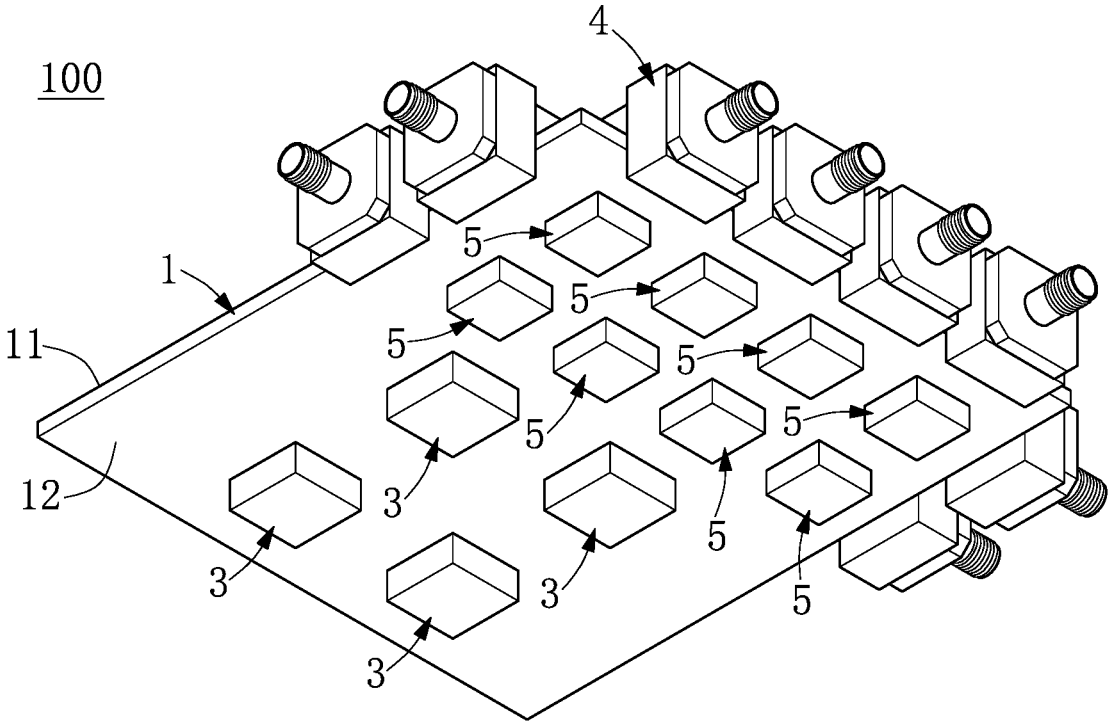
FIG. 14 is a perspective view of the high frequency antenna device according to the third embodiment of the present disclosure.

Referring to FIG. 13 and FIG. 14, a third embodiment of the present disclosure provides is similar to the first embodiment of the present disclosure, so that the descriptions of the same components in the first and third embodiments of the present disclosure will be omitted for the sake of brevity, and the following description only discloses different features between the first and third embodiment.

In the present embodiment, the high frequency antenna device 100 further includes a plurality of down-converting chips 5. Since each of the antennas 21 in the present embodiment is dual-polarized, the number of the down-converting chips 5 is double of the number of the subarrays 20.

Each two of the down-converting chips 5 are electrically coupled to one of the subarrays 20 through one of the processing chips 3, and are electrically coupled to two of the connectors 4, respectively. Specifically, the down-converting chips 5 are mounted on conductive circuits that electrically connect the connectors 4 to the processing chips 3, so that signals transmitted between each of the connectors and the corresponding processing chip 3 have to be down-converted processed by the corresponding down-converting chip 5. In other words, each of the processing chips 3 is electrically coupled to two of the connectors 4 through the two corresponding down-converting chips 5.

Moreover, each two of the down-converting chips 5 electrically correspond to the horizontal polarization and the vertical polarization of each of the antennas 21 of the corresponding subarray 20, respectively.

Specifically, each of the down-converting chips 5 is configured to reduce a high frequency signal from the processing chip 3 within a range of 20-45 GHz into a down-converting signal within a range of 2-6 GHz, and each of the connectors 4 is configured to transmit the down-converting signal from the corresponding down-converting chip 5. Accordingly, the connectors 4 in the high frequency antenna device 100 of the present embodiment can have a lower standard (e.g., the connectors 4 can only satisfy 4G standard), thereby effectively reducing production cost to easily promote the high frequency antenna device 100.

In conclusion, the high frequency antenna device (and the antenna array) of the present disclosure has a plurality of operation modes, and the antenna array can be operated in at least one of operation modes. Accordingly, the antenna array of the high frequency antenna device can be operated in automatically selecting at least one of the operation modes according to position of at least one external electronic device, so that high frequency antenna device can effectively achieve a better operation performance.

Moreover, the high frequency antenna device (and the antenna array) of the present disclosure can be applied to an operation frequency band within a range of 20-45 GHz (or a millimeter wave frequency band) and have a better transmitting performance through the structural design and the arrangement of the antennas of the antenna array (e.g., each of the antennas is configured to be selectively operated in a horizontal polarization and a vertical polarization; and in any two of the antennas adjacent to each other, the two central points are spaced apart from each other by an interval having a specific value).

In addition, the high frequency antenna device of the present disclosure can be provided with the down-converting chips, and each of the connectors is electrically coupled to the processing chip through the corresponding down-converting chip, so that each of the connectors can transmit a down-converting signal from the corresponding down-converting chip. Accordingly, the connectors in the high frequency antenna device of the present disclosure can have a lower standard, thereby effectively reducing production cost to easily promote the high frequency antenna device.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A high frequency antenna device for an operation frequency band within a range of 20-45 GHz, comprising:

a substrate having a first board surface and a second board surface opposite to the first board surface;

an antenna array disposed on the first board surface of the substrate and including a plurality of subarrays spaced apart from each other, wherein each of the subarrays includes a plurality of antennas arranged in rows, and the subarrays have the same arrangement, and wherein any two of the antennas of each of the subarrays adjacent to each other respectively have two central points spaced apart from each other by a first interval, and any two of the antennas respectively belonging to two of the subarrays and arranged adjacent to each other respectively have two central points spaced apart from each other by a second interval equal to the first interval; and a plurality of processing chips mounted on the second board surface of the substrate, wherein the processing chips are electrically coupled to the subarrays, respectively, so that each of the processing chips is electrically coupled to the antennas of the corresponding subarray, wherein the antenna array has a plurality of operation modes and is operated in at least one of the operation modes, and the operation modes include:

a first mode: any one of the subarrays is wirelessly communicated with an external electronic device spaced apart from the corresponding subarray by a first distance within a first range; and a second mode: two of the subarrays adjacent to each other are jointly cooperated to wirelessly communicate with an external electronic device spaced apart from the corresponding two subarrays by a second distance within a second range, and the first distance is less than the second distance.

2. The high frequency antenna device according to claim 1, wherein the subarrays of the antenna array are arranged in one row or in a matrix arrangement.

3. The high frequency antenna device according to claim 1, wherein the number of the subarrays of the antenna array is at least three, and the operation modes further include a third mode: all of the subarrays are jointly cooperated to wirelessly communicate with an external electronic device spaced apart from the subarrays by a third distance within a third range, and the second distance is less than the third distance.

4. The high frequency antenna device according to claim 1, wherein each of the antennas is a dual-polarized metal sheet configured to be selectively operated in a horizontal polarization and a vertical polarization.

5. The high frequency antenna device according to claim 4, wherein each of the antennas defines a first feeding point in horizontal polarization and a second feeding point in vertical polarization, and wherein in each of the antennas, the first feeding point, the second feeding point, and the central point jointly define a right angle.

6. The high frequency antenna device according to claim 4, wherein the antennas of the antenna array are arranged in M numbers of rows and N numbers of columns, each of M and N is a positive integer more than one, and the antennas of the antenna array are in a matrix arrangement.

7. The high frequency antenna device according to claim 4, wherein the antennas of the antenna array are arranged in M numbers of rows, and M is a positive integer more than one, and wherein in two adjacent ones of the M numbers of rows, the antennas of one of the two rows and the antennas of the other one of the two rows are staggeredly arranged with each other.

8. The high frequency antenna device according to claim 4, wherein the number of the processing chips is equal to the number of the subarrays, the high frequency antenna device further includes a plurality of down-converting chips, and the number of the down-converting chips is double of the number of the subarrays, wherein each two of the down-converting chips are electrically coupled to one of the subarrays through one of the processing chips, and electrically correspond to the horizontal polarization and the vertical polarization of each of the antennas of the corresponding subarray, respectively, and wherein each of the two down-converting chips is configured to reduce a high frequency signal from the corresponding processing chip within a range of 20-45 GHz into a down-converting signal within a range of 2-6 GHz.

9. An antenna array of a high frequency antenna device for an operation frequency band within a range of 20-45 GHz, comprising:

a plurality of subarrays spaced apart from each other, wherein each of the subarrays includes a plurality of antennas arranged in rows, and the subarrays have the same arrangement, and wherein any two of the antennas of each of the subarrays adjacent to each other respectively have two central points spaced apart from each other by a first interval, and any two of the antennas respectively belonging to two of the subarrays and arranged adjacent to each other respectively have two central points spaced apart from each other by a second interval equal to the first interval, wherein the antenna array has a plurality of operation modes and is operated in at least one of the operation modes, and the operation modes include:

a first mode: any one of the subarrays is wirelessly communicated with an external electronic device spaced apart from the corresponding subarray by a first distance within a first range; and a second mode: at least two of the subarrays adjacent to each other are jointly cooperated to wirelessly communicate with an external electronic device spaced apart from the corresponding at least two subarrays by a second distance within a second range, and the first distance is less than the second distance.

10. The antenna array according to claim 9, wherein the number of the subarrays of the antenna array is at least three, and the operation modes further include a third mode: all of the subarrays are jointly cooperated to wirelessly communicate with an external electronic device spaced apart from the subarrays by a third distance within a third range, and the second distance is less than the third distance.

* * * * *